US009693659B1

(12) United States Patent
Cancio

(10) Patent No.: US 9,693,659 B1
(45) Date of Patent: Jul. 4, 2017

(54) BATHTUB SEAT

(71) Applicant: Jorge Cancio, La Villa De Torrimar, PR (US)

(72) Inventor: Jorge Cancio, La Villa De Torrimar, PR (US)

( * ) Notice: Subject to any disclaimer, the term of this patent is extended or adjusted under 35 U.S.C. 154(b) by 0 days.

(21) Appl. No.: 14/969,099

(22) Filed: Dec. 15, 2015

(51) Int. Cl.
*A47K 3/10* (2006.01)
*A47K 3/12* (2006.01)
*A47K 3/00* (2006.01)

(52) U.S. Cl.
CPC ..... *A47K 3/122* (2013.01); *A47K 3/001* (2013.01)

(58) Field of Classification Search
CPC .. A47C 9/06; A47B 67/02; A47B 3/00; A47K 3/122
See application file for complete search history.

(56) References Cited

U.S. PATENT DOCUMENTS

| | | | | |
|---|---|---|---|---|
| 1,712,704 | A | 5/1929 | Kiser | |
| 1,923,482 | A | 8/1933 | Frankenstein | |
| 2,670,029 | A | 2/1954 | Rossi | |
| 3,873,151 | A * | 3/1975 | Morris | A47C 9/06 297/14 |
| 4,087,127 | A | 5/1978 | Lotta | |
| 4,400,835 | A | 8/1983 | Richter | |
| 5,048,132 | A | 9/1991 | Rizzo | |
| 5,185,892 | A | 2/1993 | Mitchell | |
| 5,228,151 | A | 7/1993 | Livingston-Capoano | |
| 5,548,855 | A | 8/1996 | Jackson | |
| 2,792,053 | A1 | 9/2011 | Steven | |

* cited by examiner

*Primary Examiner* — Janie Loeppke
(74) *Attorney, Agent, or Firm* — Kyle A. Fletcheer, Esq.

(57) ABSTRACT

The bathtub seat is a shelving cabinet that is mounted into the wall adjacent to a bathtub. The bathtub seat has attached to it a foraminous door that swings away from the shelving cabinet towards the side of the bathtub such that the foraminous door is supported by the side of the bathtub that is distal to the side of the bathtub that that is proximal to the shelving cabinet. The bathtub seat comprises a shelving cabinet and a foraminous door.

8 Claims, 5 Drawing Sheets

BATHTUB SEAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture for baths and other sanitary purposes, more specifically, a seat for use in a bathtub.

SUMMARY OF INVENTION

The bathtub seat is a shelving cabinet that is mounted into the wall adjacent to a bathtub. The bathtub seat has attached to it a foraminous door that swings away from the shelving cabinet towards the side of the bathtub such that the foraminous door is supported by the side of the bathtub that is distal to the side of the bathtub that that is proximal to the shelving cabinet.

These together with additional objects, features and advantages of the bathtub seat will be readily apparent to those of ordinary skill in the art upon reading the following detailed description of the presently preferred, but nonetheless illustrative, embodiments when taken in conjunction with the accompanying drawings.

In this respect, before explaining the current embodiments of the bathtub seat in detail, it is to be understood that the bathtub seat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bathtub seat.

It is therefore important that the claims be regarded as including such equivalent construction insofar as they do not depart from the spirit and scope of the bathtub seat. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
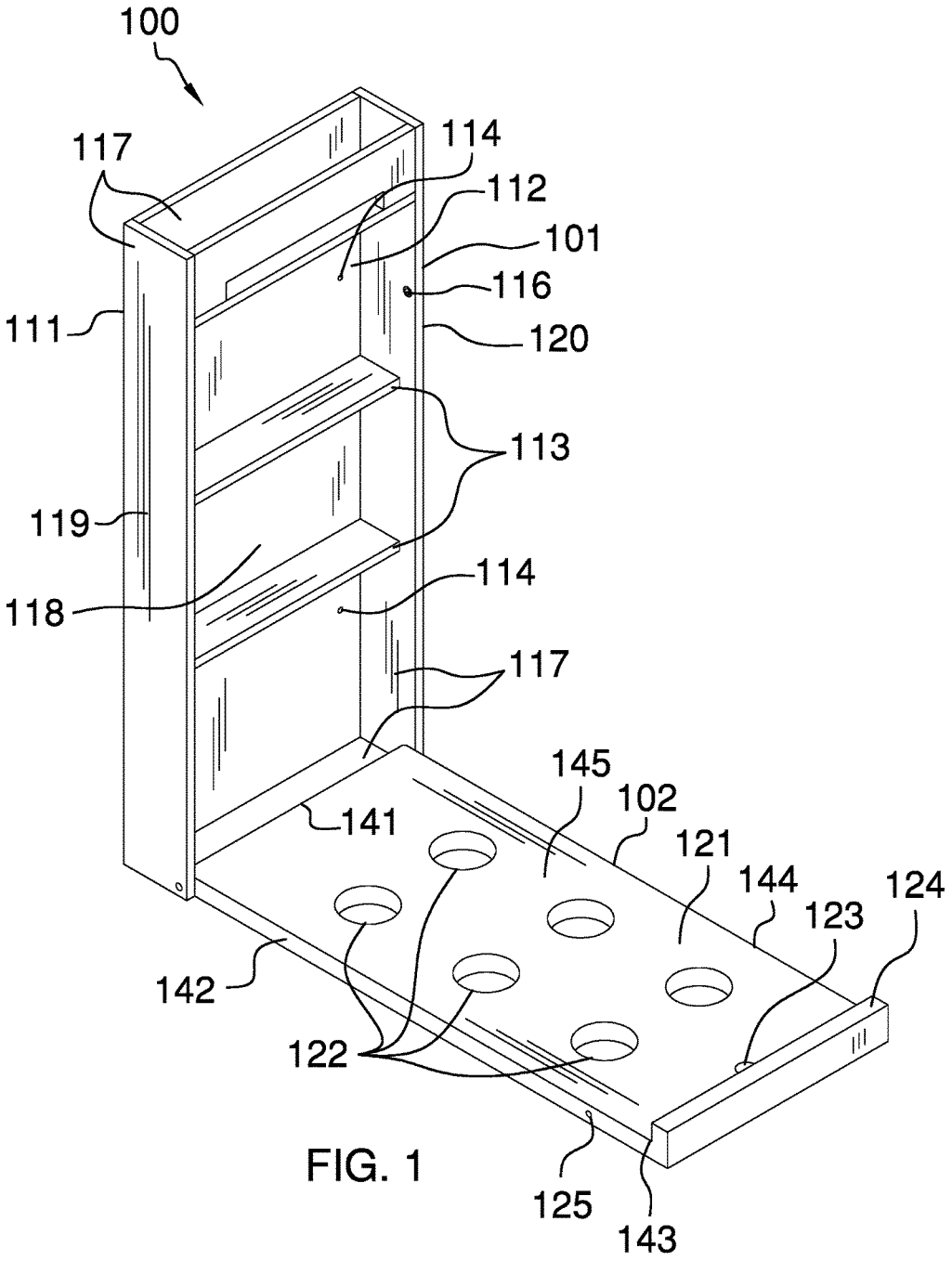
FIG. 1 is a perspective view of an embodiment of the disclosure.
Figure 2:
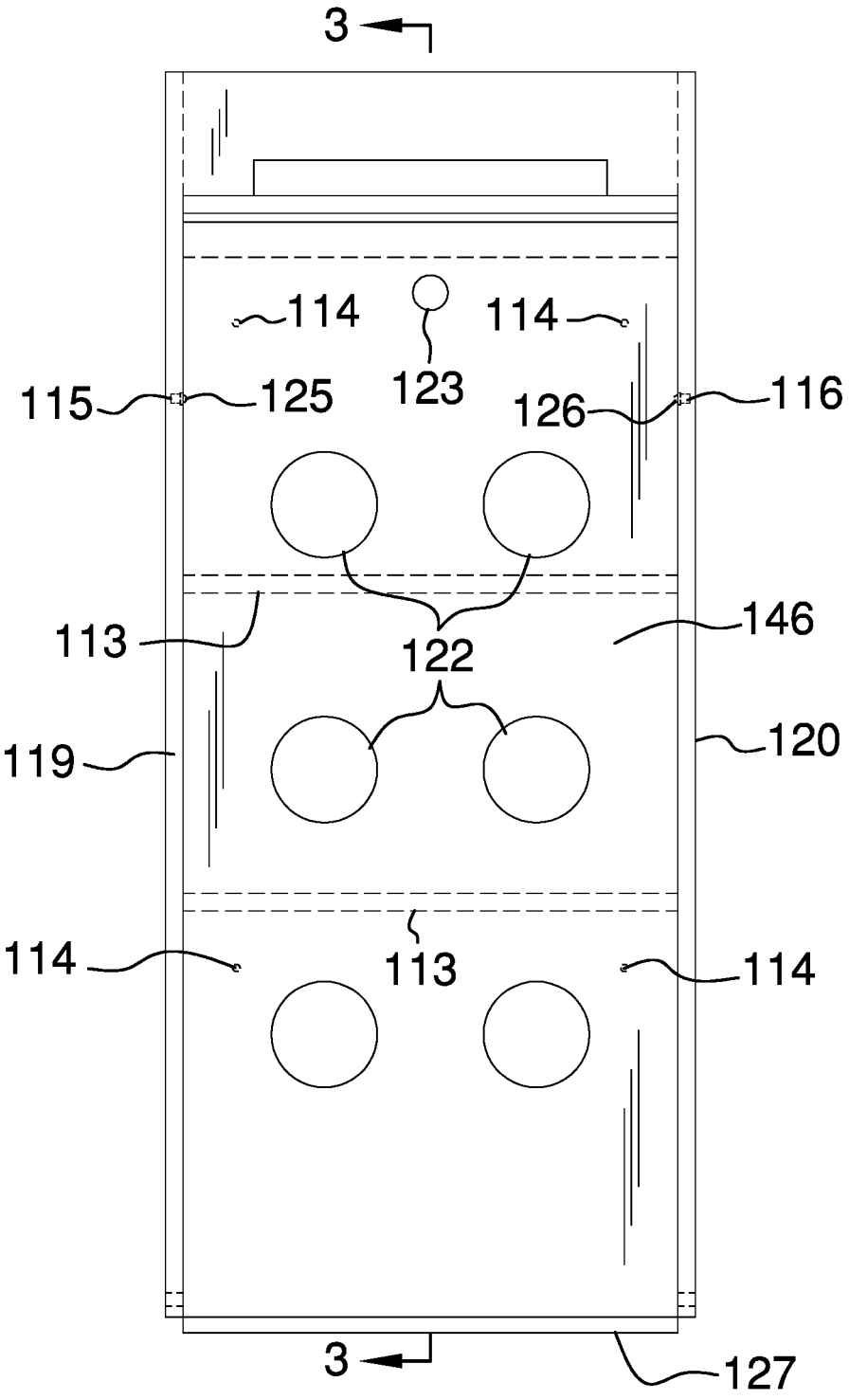
FIG. 2 is a front view of an embodiment of the disclosure.
Figure 3:
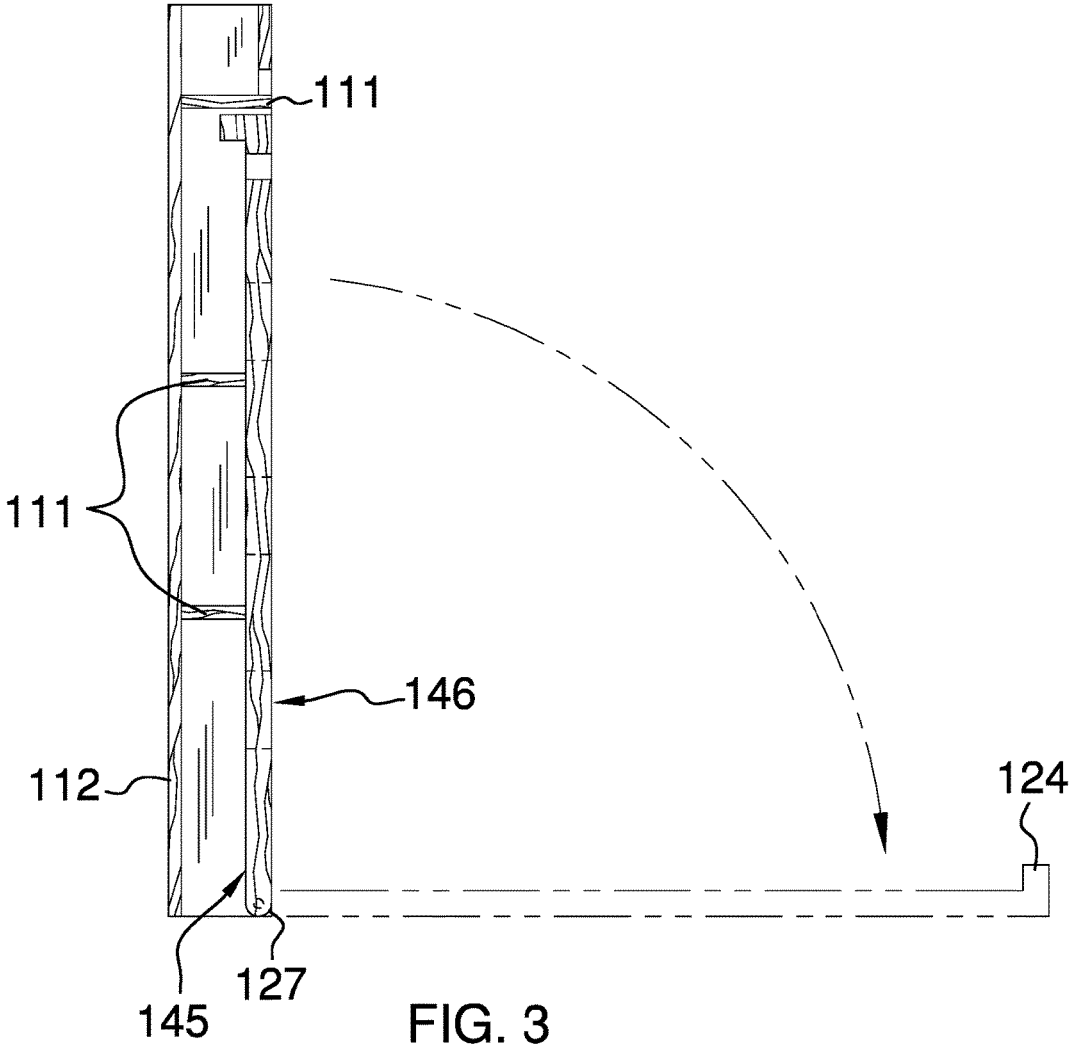
FIG. 3 is a side view of an embodiment of the disclosure.
Figure 4:
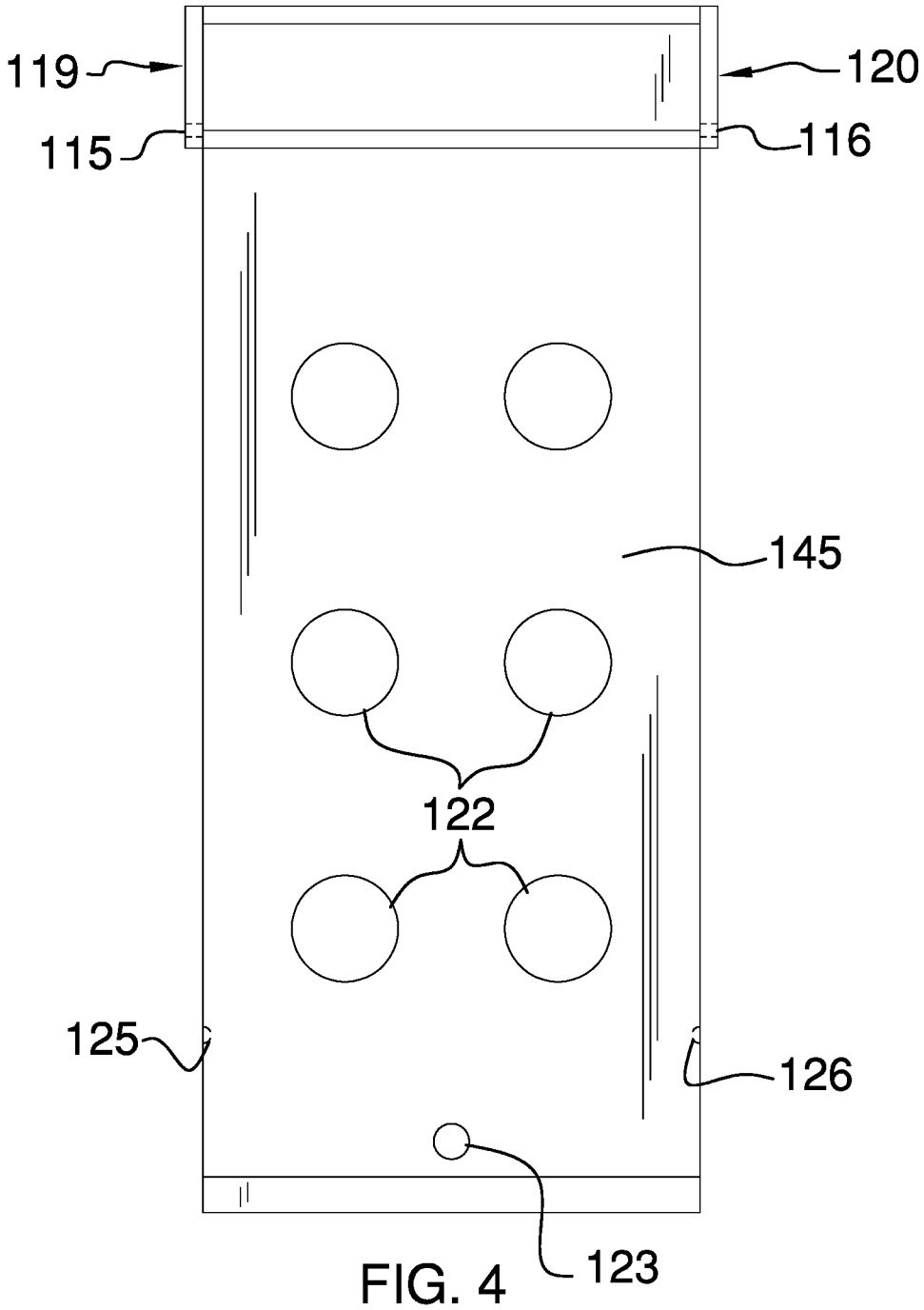
FIG. 4 is a top view of an embodiment of the disclosure.
Figure 5:
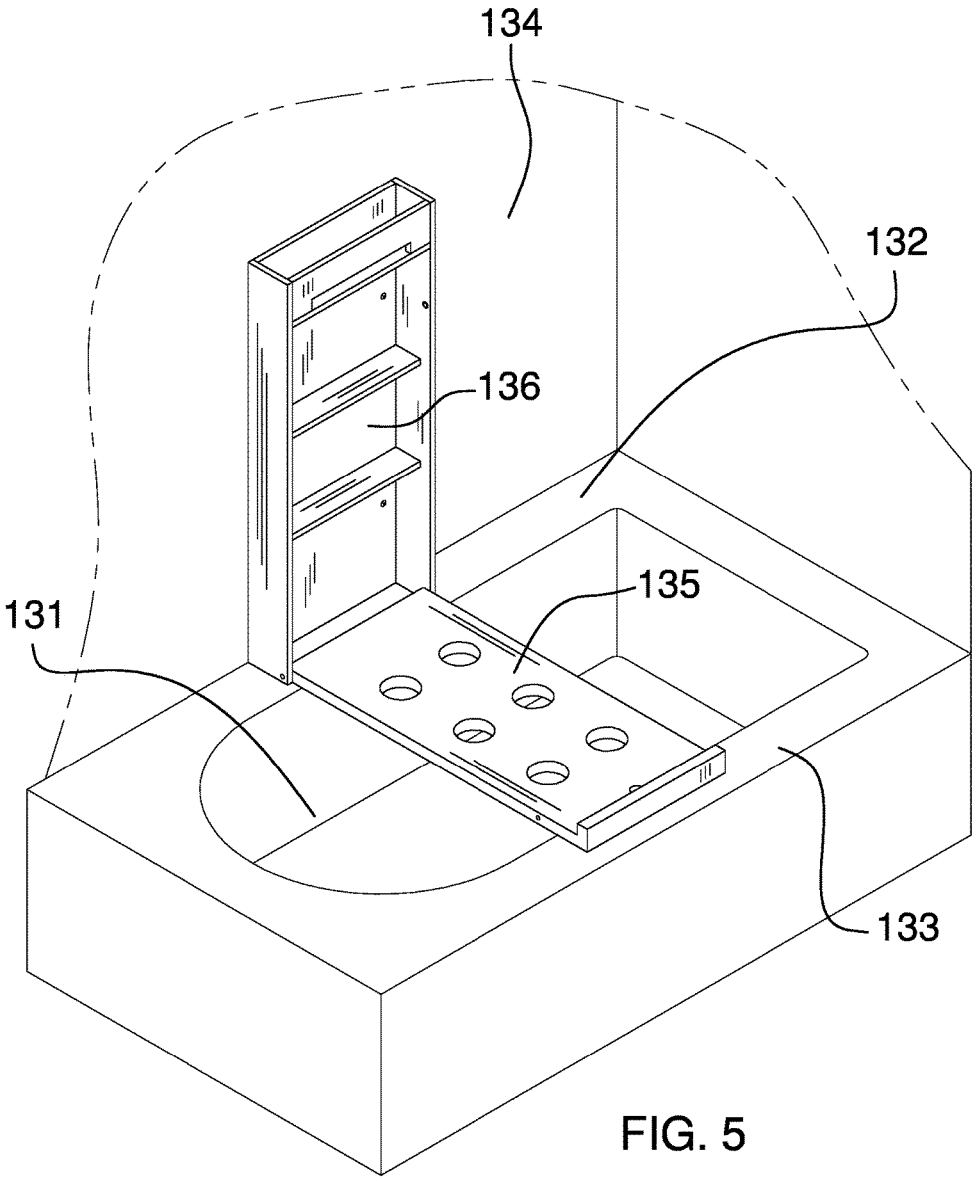
FIG. 5 is an in use view of an embodiment of the disclosure.

Detailed reference will now be made to a first potential embodiment of the disclosure, which is illustrated in FIGS. 1 through 5.

The bathtub seat 100 (hereinafter invention) comprises a shelving cabinet 101 and a foraminous door 102. The invention 100 is adapted for use with a bathtub 131. The invention 100 is as a seat 135 while opened into the bathtub 131. The invention 100 is adapted such that it can be mounted to a wall 134 next to the bathtub 131. The foraminous door 102 swings away from the shelving cabinet 101 such that the foraminous door 102 is supported by the distal bathtub side 133 of the bathtub 131 relative to the side of the bathtub 131 that that is proximal to the shelving cabinet 101 which is referred to as the proximal bathtub side 132.

The shelving cabinet 101 further comprises a frame 111, a plurality of shelves 113, a plurality of mounting holes 114, a first spring loaded lock ball 115, and a second spring loaded lock ball 116. The frame 111 is a shell that is shaped in the form of a rectangular block that further comprises four sides 117, a back panel 112, and an open face 118. The four sides 117 further comprises a first vertical side 119 and a second vertical side 120. The back panel 112 has formed in it the plurality of mounting holes 114 that are used to mount the frame 111 to a wall 134 that is adjacent to the bathtub 131. The frame 111 is mounted to the wall 134 that is adjacent to the bathtub 131 using commercially available hardware. The sixth side of the frame 111 is an open face 118. Access to the interior space 136 of the frame 111 is through the open face 118.

The interior space 136 of the frame 111 has mounted in it a plurality of shelves 113. Each of the plurality of shelves 113 is a horizontal surface formed within the interior space 136 of the frame 111 that can be used for the storage of objects. The first spring loaded lock ball 115 is installed in the first vertical side 119 such that it faces the interior space 136 of the frame 111. The second spring loaded lock ball 116 is installed in the second vertical side 120 such that it faces the interior space 136 of the frame 111. Spring loaded lock balls are commercially available. Spring loaded lock balls and the use of the spring loaded lock balls are described elsewhere in this disclosure.

The foraminous door 102 further comprises a platform 121, a plurality of holes 122, a finger hole 123, a rim 124, a first dimple 125, a second dimple 126, and one or more hinges 127. The platform 121 is a structure formed in the shape of a rectangular block that is sized to cover the open face 118 of the frame 111. The platform 121 is both a door that is used to close the shelving cabinet 101 and is the seat 135 upon which the user will sit. The platform 121 is further defined with a first side 141, a second side 142, a third side 143, a fourth side 144, an interior side 145, and an exterior side 146. The one or more hinges 127 attach to the first side 141. The rim 124 is attached to the interior surface 145 of the third side 143. The interior surface 145 faces the interior space 136 of the frame 111 when the foraminous door 102 is in the closed position. The third side 143 is distal from the first side 141. The second side 142 is proximal to the first vertical side 119 when the foraminous door 102 is in the closed position. The fourth side 144 is distal from the second side 142 and is proximal to the second vertical side 120 when the foraminous door 102 is in the closed position. The exterior surface 146 is the surface that is distal from the interior surface 145.

The plurality of holes 122 are holes that are formed in the platform 121 such that each hole 122 selected from the plurality of holes 122 is formed entirely through the platform 121 in the direction from the interior surface 145 to the exterior surface 146. The plurality of holes 122 allow water spilled on the interior surface 145 to drain back into the bathtub 131. The finger hole 123 is a hole that is formed near the third side 143 of the platform 121 in the direction from the interior surface 145 to the exterior surface 146. The finger hole 123 provides a grip for the user to use to open the foraminous door 102 when it is closed. The rim 124 is a ridge that is formed along the third side 143 of the interior surface 145 that projects perpendicularly away from the platform 121 in the direction away from the exterior surface 146. The rim 124 is a barrier that prevents items placed on the platform 121 from rolling off the third side 143 of the platform 121. The first dimple 125 is a groove that is formed in the second side 142 of the platform 121. The first dimple 125 is sized to receive the first spring loaded lock ball 115 when the foraminous door 102 is closed. The second dimple 126 is a groove that is formed in the fourth side 144 of the platform 121. The second dimple 126 is sized to receive the second spring loaded lock ball 116 when the foraminous door 102 is closed.

The platform 121 is attached to the frame 111 using the one or more hinges 127. The one or more hinges 127 are used to attach the first side 141 of the platform 121 to the frame 111 such that the foraminous door 102 swings away from the shelving cabinet 101 towards the distal bathtub side 133 such that the third side 143 of the platform 121 can rest upon the distal bathtub side 133.

To use the invention 100, the user swings the foraminous door 102 open using the one or more hinges 127 as a pivot until the foraminous door 102 rests on the distal bathtub side 133. The user uses the interior surface 145 of the platform 121 as a seat 135 during bathing activities. When bathing activities are completed, the foraminous door 102 is swing towards the shelving cabinet 101 using the one or more hinges 127 as a pivot until the first spring loaded lock ball 115 is inserted into the first dimple 125 and the second spring loaded lock ball 116 is inserted into the second dimple 126 thus securing the foraminous door 102 in the closed position.

The frame 111, the plurality of shelves 113, and the plurality of mounting holes 114 can be formed as a single unit from molded plastic. Suitable plastics include, but are not limited to, polyvinylchloride. The first spring loaded lock ball 115 and the second spring loaded lock ball 116 are commercially available. The foraminous door 102 can be formed as a single unit from molded plastic. Suitable plastics include, but are not limited to, polyvinylchloride. The one or more hinges 127 are commercially available. In the first potential embodiment of the disclosure, a piano hinge was used.

The following definitions were used in this disclosure:

Detent: As used in this disclosure, a detent is a device for positioning and holding one mechanical part in relation to another in a manner such that the device can be released by force applied to one or more of the parts.

Foraminous: As used in this disclosure, foraminous is an adjective that describes a surface, plate, or platform that is perforated with a plurality of holes.

Hinge: As used in this disclosure, a hinge is a device that permits the turning, rotating, or pivoting of a first object relative to a second object.

Piano Hinge: As used in this disclosure, a piano hinge is: 1) a hinge that is longer than 12 inches in at least one dimension; and 2) has a pin that runs fully along at least one of the surfaces that the piano hinge is attached to.

Pivot: As used in this disclosure, a pivot is a rod or shaft around which an object rotates or swings.

Spring Loaded Lock Ball: As used in this disclosure, a spring loaded lock is a detent formed from a spring loaded bearing located in a first object which retracts and then snaps into an opposing hole or groove formed in a second object to hold the second object in position. They are also commonly referred to as ball detents, spring loaded plungers, spring plungers, and ball locks.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A seat comprising:

shelving cabinet and a foraminous door;

wherein the seat is adapted for use with a bathtub;

wherein the seat opens into the bathtub;

wherein the seat is mounted to a wall next to the bathtub;

wherein the foraminous door swings away from the shelving cabinet such that the foraminous door is supported by the distal bathtub side of the bathtub relative to the proximal bathtub side;

wherein the shelving cabinet further comprises a frame, a plurality of shelves, a plurality of mounting holes, a first spring loaded lock ball, and a second spring loaded lock ball;

wherein the frame is a shell that is shaped in the form of a rectangular block that further comprises four sides, a back panel, and an open face;

wherein the four sides further comprises a first vertical side and a second vertical side;

wherein the back panel has formed in it the plurality of mounting holes;

wherein the frame is mounted to a wall that is adjacent to the bathtub;

wherein the access to the interior space of the frame is through the open face;

wherein the interior space of the frame has mounted in it a plurality of shelves;

wherein the first spring loaded lock ball is installed in the first vertical side such that it faces the interior space of the frame;

wherein the second spring loaded lock ball is installed in the second vertical side such that it faces the interior space of the frame;

wherein the foraminous door further comprises a platform, a plurality of holes, a finger hole, a rim, a first dimple, a second dimple, and one or more hinges;

wherein the platform is a structure formed in the shape of a rectangular block that is sized to cover the open face of the frame;

wherein the platform is further defined with a first side, a second side, a third side, a fourth side, an interior side, and an exterior side.

2. The seat according to claim 1 wherein the one or more hinges attach to the first side to the frame.

3. The seat according to claim 2 wherein the rim is attached the third side on the interior surface.

4. The seat according to claim 3 wherein the plurality of holes are formed in the platform.

5. The seat according to claim 4 wherein the plurality of holes are formed such that each hole selected from the plurality of holes is formed entirely through the platform.

6. The seat according to claim 5 wherein the finger hole is a hole that is in the area of the third side of the platform.

7. The seat according to claim 6 wherein the first dimple is a groove that is formed in the second side of the platform;

wherein the second dimple is a groove that is formed in the fourth side of the platform.

8. The seat according to claim 7 wherein the first dimple is sized to receive the first spring loaded lock ball;

wherein the second dimple is sized to receive the second spring loaded lock ball.

* * * * *